US007263034B2

(12) United States Patent
Ramenzoni

(10) Patent No.: US 7,263,034 B2
(45) Date of Patent: Aug. 28, 2007

(54) RESONATOR DEVICE AND CIRCUITS FOR 3-D DETECTION/RECEIVING SONIC WAVES, EVEN OF A VERY LOW AMPLITUDE/FREQUENCY, SUITABLE FOR USE IN CYBERNETICS

(75) Inventor: Daniele Ramenzoni, Fidenza (IT)

(73) Assignee: Andrea Chiesi, Parma (IT)

( * ) Notice: Subject to any disclaimer, the term of this patent is extended or adjusted under 35 U.S.C. 154(b) by 0 days.

(21) Appl. No.: 10/505,932

(22) PCT Filed: Feb. 20, 2003

(86) PCT No.: PCT/IT03/00096

§ 371 (c)(1),
(2), (4) Date: Jul. 13, 2005

(87) PCT Pub. No.: WO03/079725

PCT Pub. Date: Sep. 25, 2003

(65) Prior Publication Data

US 2005/0270906 A1 Dec. 8, 2005

(30) Foreign Application Priority Data

Mar. 18, 2002 (IT) ..... M12002A000566

(51) Int. Cl.
*H04R 5/027* (2006.01)

(52) U.S. Cl. ..... 367/188

(58) Field of Classification Search ..... 367/118, 367/188; 381/26

See application file for complete search history.

(56) References Cited

U.S. PATENT DOCUMENTS 1,689,121 A 10/1928 Ferdon
3,800,088 A 3/1974 Bode
3,811,782 A 5/1974 Kerr
3,824,342 A 7/1974 Christensen
3,887,896 A 6/1975 Ramstedt
4,042,779 A 8/1977 Craven et al.
4,536,887 A 8/1985 Kaneda et al.
4,703,506 A 10/1987 Sakamoto et al.
4,751,738 A 6/1988 Widrow et al.
4,752,961 A 6/1988 Kahn
5,073,936 A 12/1991 Gorike et al.
5,386,082 A 1/1995 Higashi
5,581,620 A 12/1996 Brandstein et al.

(Continued)

FOREIGN PATENT DOCUMENTS

DE 35 28 075 A1 2/1987

(Continued)

OTHER PUBLICATIONS

International Preliminary Examination Report.

*Primary Examiner*—Dan Pihulic
(74) *Attorney, Agent, or Firm*—Hedman & Costigan P.C.; James V. Costigan

(57) ABSTRACT

A resonator device comprises a plurality of transducers fitted and spatially aligned on the four prongs of two tuning forks, with vibrating masses, placed side-by-side with the four prongs arranged at 90° angles one from the other in a clockwise or anticlockwise direction, the distance between the individual prongs, their dimensions, shapes and masses, producing mechanical vibrations and resonances at predetermined frequencies.

7 Claims, 5 Drawing Sheets

U.S. PATENT DOCUMENTS

| | | | | |
|---|---|---|---|---|
| 5,583,962 | A | 12/1996 | Davis et al. | |
| 5,622,172 | A | 4/1997 | Li et al. | |
| 5,793,873 | A | 8/1998 | Magyari et al. | |
| 5,793,875 | A | 8/1998 | Lehr et al. | |
| 6,041,127 | A | 3/2000 | Elko | |
| 2005/0270906 | A1 * | 12/2005 | Ramenzoni | 367/99 |

FOREIGN PATENT DOCUMENTS

| | | | |
|---|---|---|---|
| EP | 0 690 657 | A2 | 1/1996 |
| FR | 2 501 448 | | 9/1982 |
| GB | 2204402 | A | 11/1988 |
| JP | 2001-296350 | A | 10/2001 |
| WO | WO95/35012 | | 12/1995 |
| WO | WO9847022 | | 10/1998 |
| WO | WO 03/079725 | A2 | 9/2003 |
| WO | WO 3079725 | A2 * | 9/2003 |

* cited by examiner

FIG. 1/a
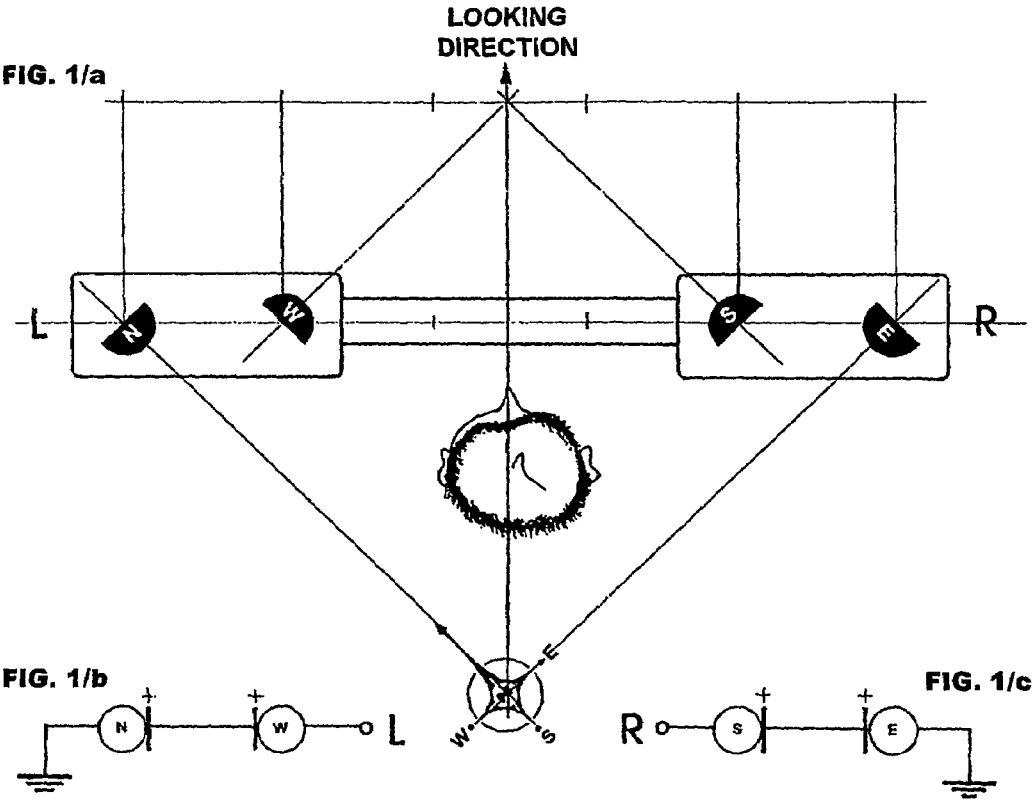
FIG. 2/a
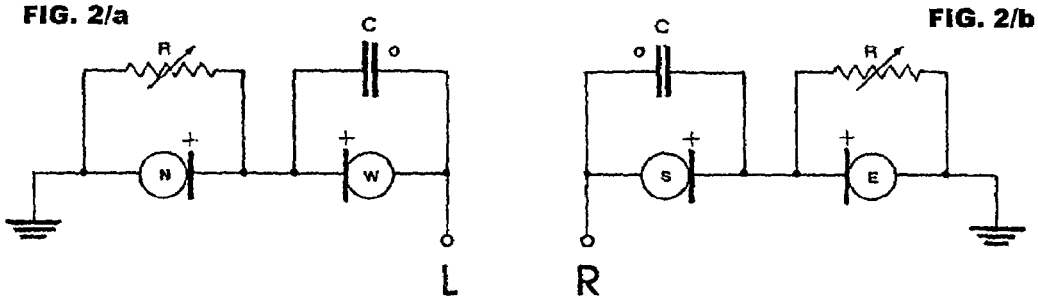
FIG. 3/a
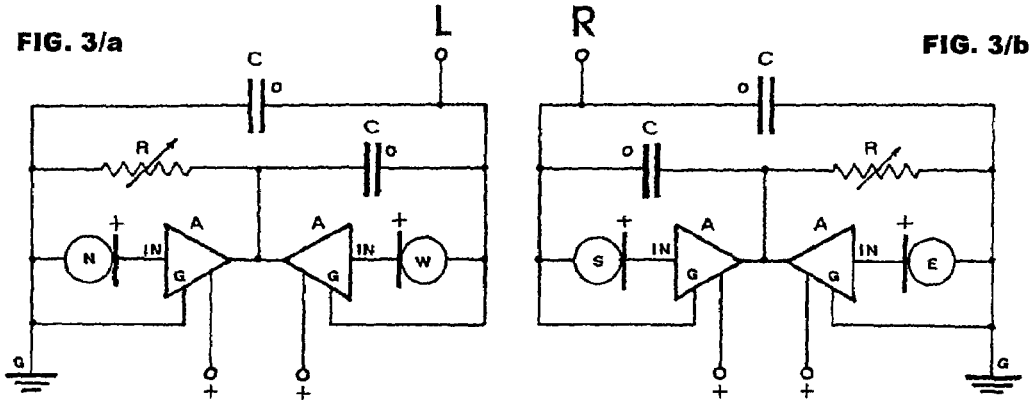

FIG. 4/a
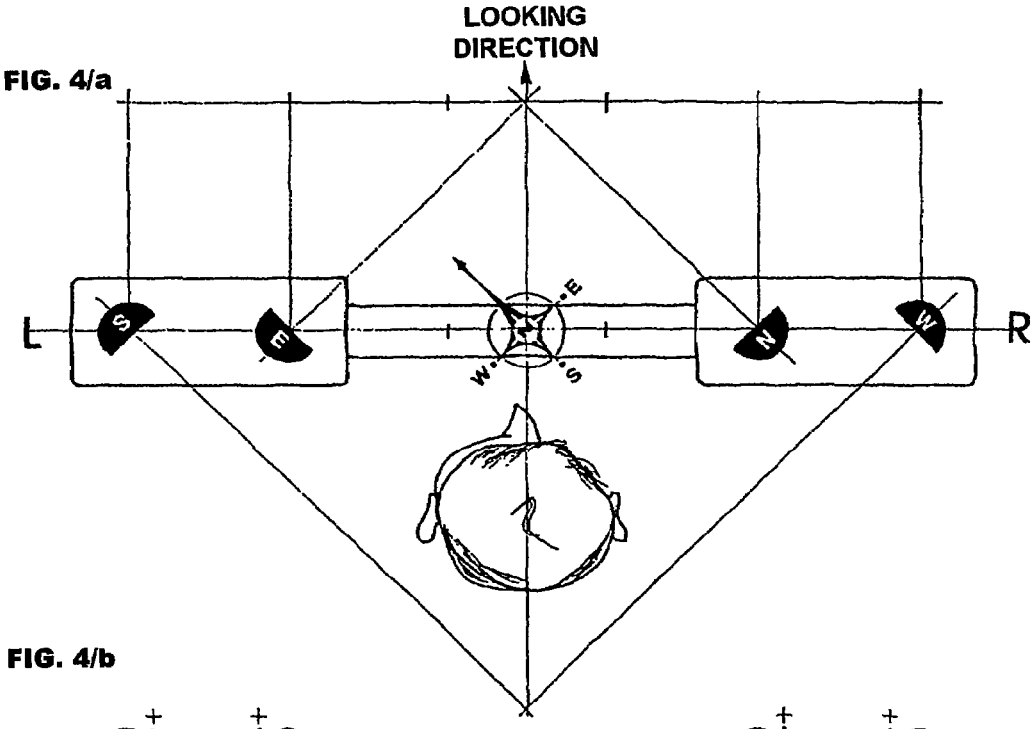
FIG. 4/b
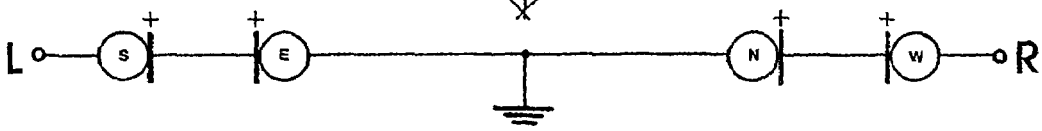
FIG. 5
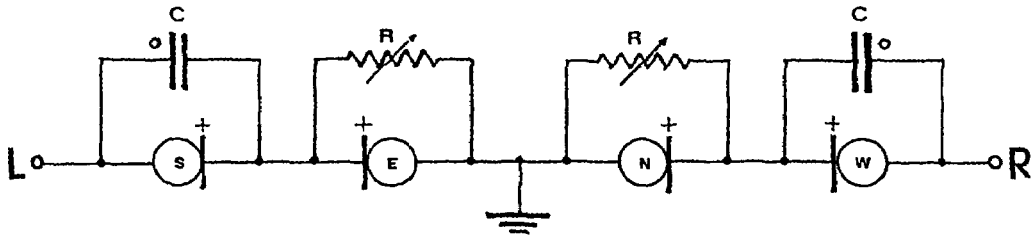
FIG. 6
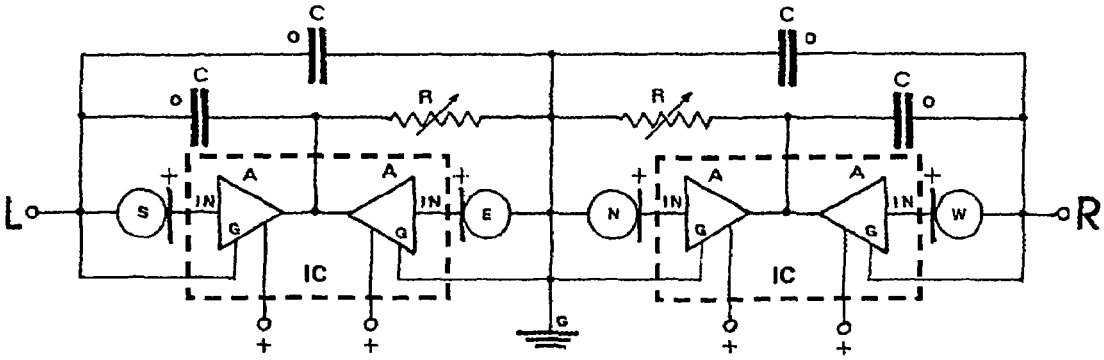

FIG. 7/a
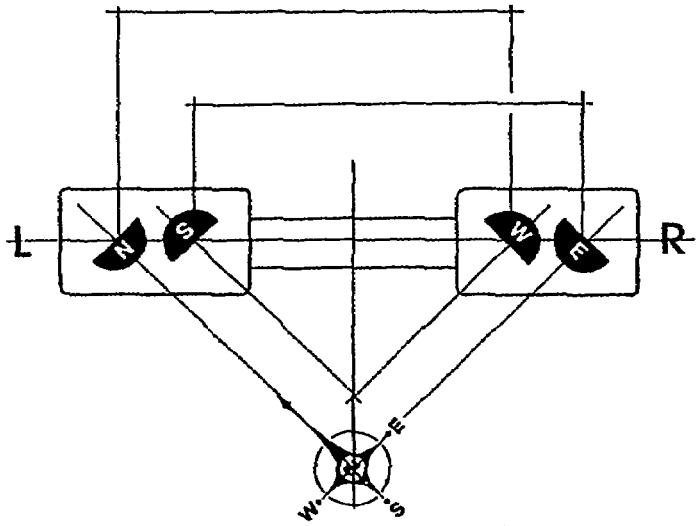
FIG. 7/b
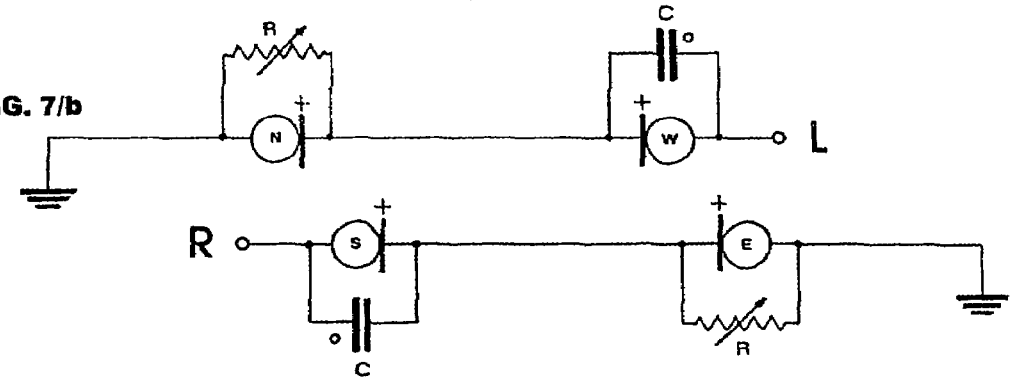
FIG. 8
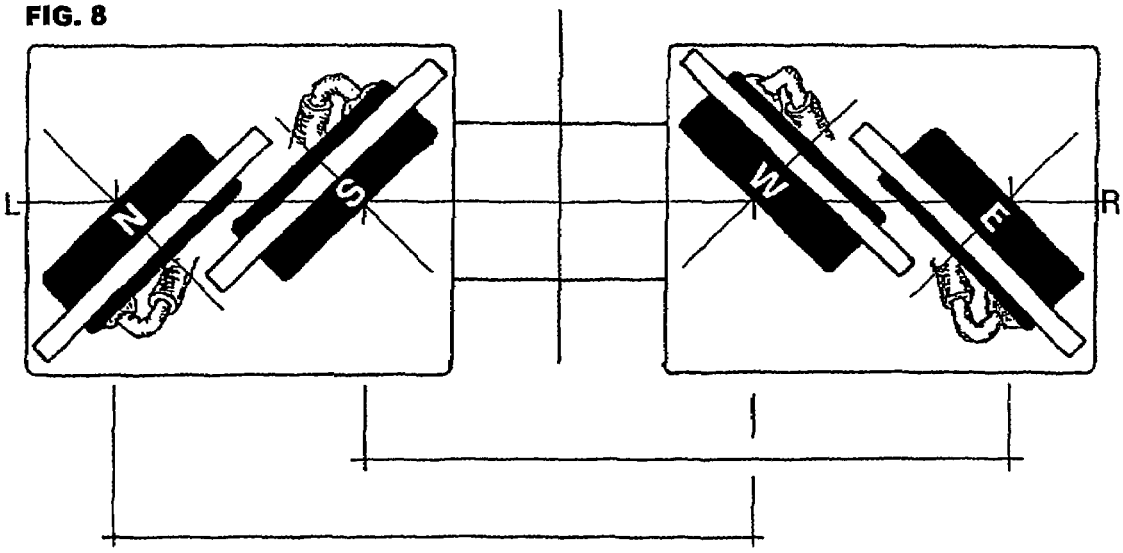

FIG. 9/a
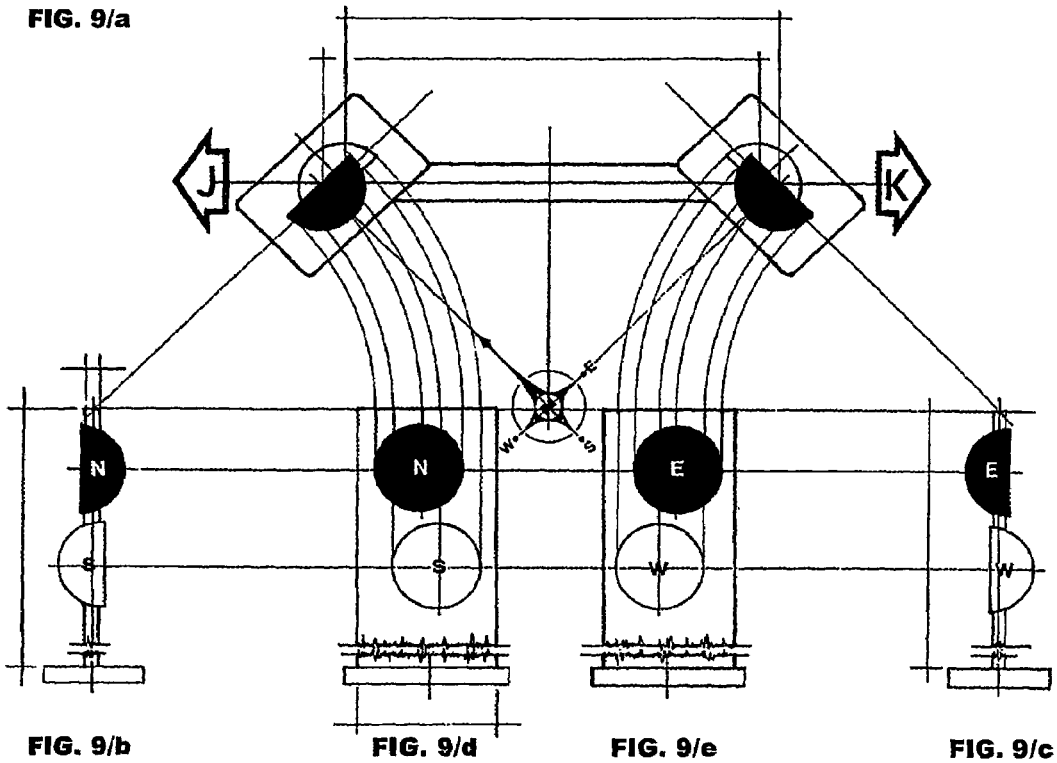
FIG. 9/b FIG. 9/d FIG. 9/e FIG. 9/c
FIG. 10
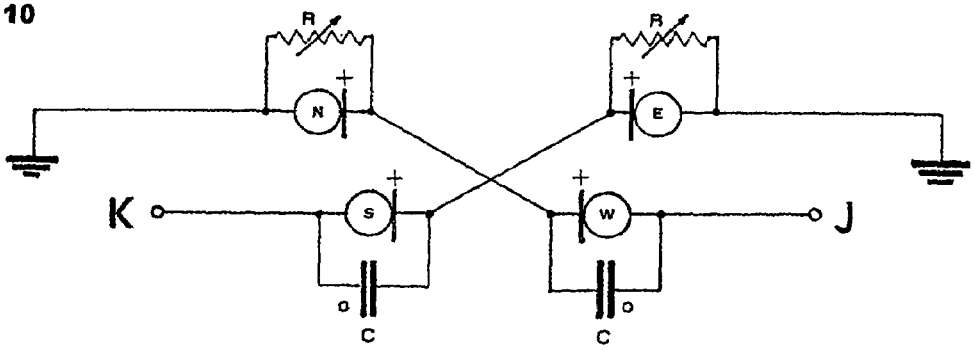
FIG. 11
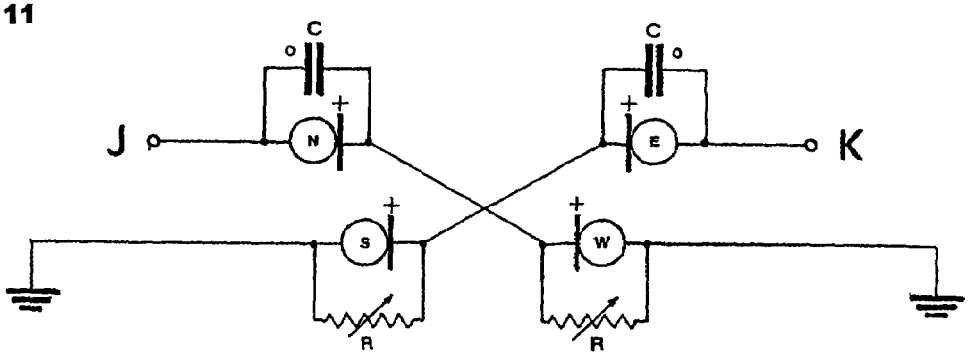

FIG. 12
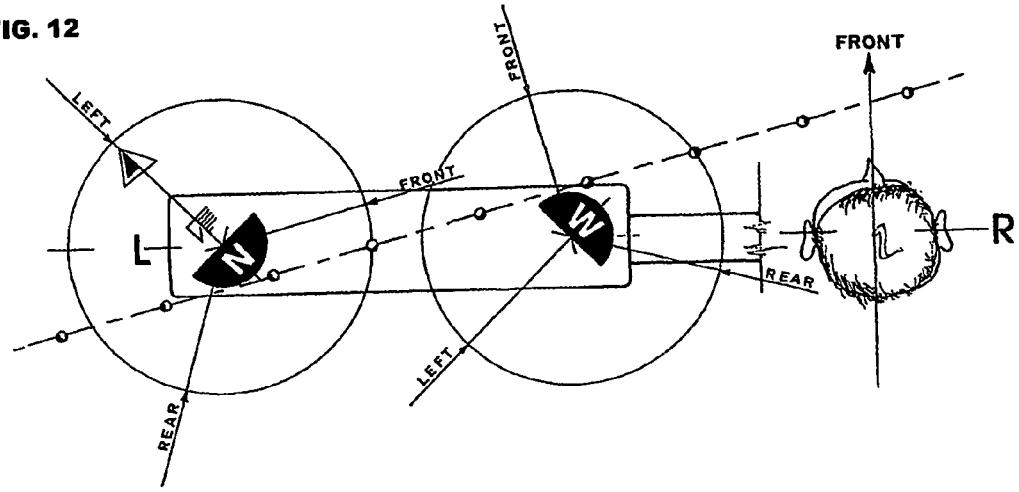
FIG. 13
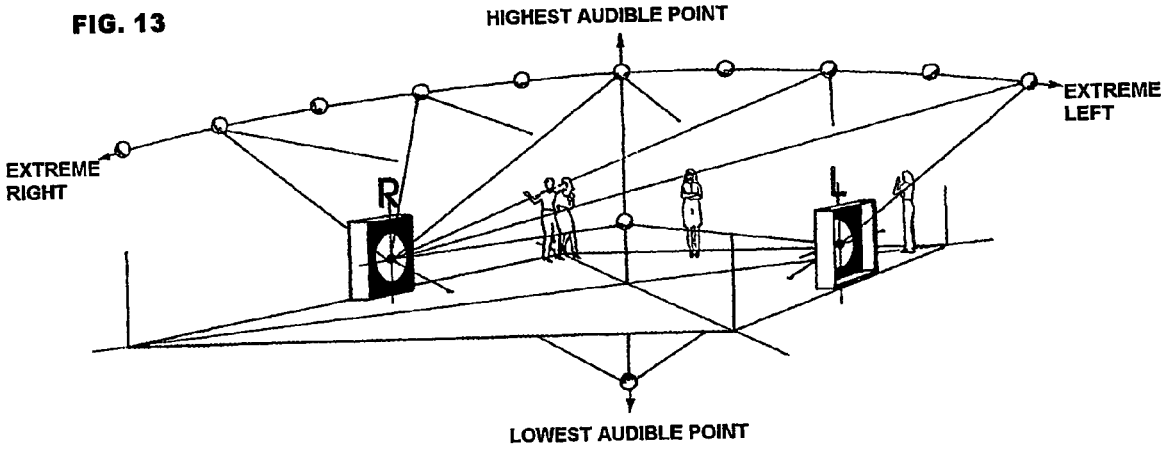
FIG. 14
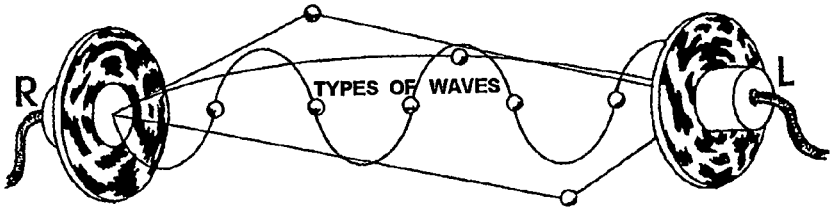
FIG. 15/a
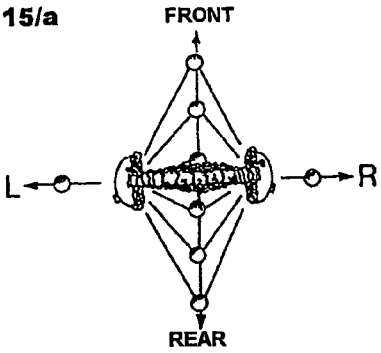
FIG. 15/b
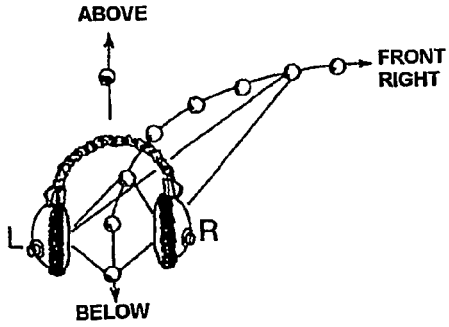

RESONATOR DEVICE AND CIRCUITS FOR 3-D DETECTION/RECEIVING SONIC WAVES, EVEN OF A VERY LOW AMPLITUDE/FREQUENCY, SUITABLE FOR USE IN CYBERNETICS

BRIEF DESCRIPTION OF THE INVENTION

As the enclosed drawings show, this resonator device and circuits for tridimensional detection and receiving of sonic waves, even of a very low amplitude and frequency, in fluids, and suitable for use in cybernetics, in the form of a slender transducer system, that is always compatible with the binaural human perception of sound, in accordance with the present invention is characterised by the fact that it includes two pairs of transducers (the N, W pair corresponding to a Left-type human ear, and operates best with sounds from an anticlockwise direction, whilst the E, S pair corresponding to a Right-type human ear that, being specular to the other, operates best with sounds from a clockwise direction), that are aligned symmetrically one pair from the other, with the two left transducers always mirroring those on the right just like the human left and right ear. These four transducers are appropriately fitted and spatially aligned on corresponding support structures that can be likened to the arms or prongs of a tuning-fork. These structures can be described as being 'like two tuning-forks', with resonating/vibrating masses due to signals, fields or waves (that include electronic/electrical transducers on the prongs), placed side-by-side with the four prongs facing four different ways, arranged at 90° angles, one from the other, in an anticlockwise or clockwise direction (the passage from anticlockwise to clockwise direction, and vice versa, occurs through the simple swapping of the two transducers of a single pair, and maintaining the electrical/electronic circuits unaltered for all of the possible configurations: therefore in the first configuration, for example, in Sheet 1/5, the N transducer of the anticlockwise left pair switches from external to internal and assumes the position occupied by W, leaving, therefore the W transducer to become the most extreme outer left). The distance between the individual prongs, their dimensions, shapes and masses are set accordingly, in order to receive different longitudinal and transversal mechanical vibrations and resonances at accurately predetermined frequencies; therefore these structures can be designed for different types of applications. This resonator device can in fact be 'tuned', as though it were a musical instrument, but in this case it would be done only, or above all, to receive particular frequencies at the maximum sensitivity possible without the use of electronic amplification and/or filters (active filters, high or low pass filters, band pass filters and so on).

In the nineteenth century Hermann Ludwig Ferdinand von Helmholtz (1821-1894) used hollow balls of glass/spun brass with two directly opposing holes or neck-like apertures; the larger aperture was pointed in the direction of a sound source, and the smaller, slender nipple inserted into the ear. This device is still referred to today as a Helmholtz Resonator. The resonator device in accordance with the present invention is characterised by the fact that it represents the most sophisticated development to date of a Helmholtz resonator, and it has become a slender transducer system, that differs totally from an artificial head or dummy head. It is for this reason also that this resonator device is intended for use in a variety of different sectors, including those linked to human necessities.

This electronic/electromechanical transducer system picks up mechanical vibrations, even of time domain very low amplitude and frequency (improving the detection of geo-electrical waves induced by gravitational signals), infrasonic, sonic and ultrasonic waves, acoustic waves, shock waves, sonic booms through photo-electric detectors, acoustic, capacitive or electromechanical transducers or vibratory elements, and other types of transducer like velocity or pressure gradient microphone cartridges or capsules, to convert movement and vibrations that have been captured (in the atmosphere, surrounded by gas, immersed in water or other types of liquid) into electrical signals. All component materials that may create interference with the desired frequencies are not to be used. This resonator device can operate across a wide temperature span, starting at approximately absolute zero, right through to conditions of extreme heat, or extreme levels of humidity also with dust, magnetic fields, radioactivity and so on, in accordance with the present invention consisting of a slender cybernetic transducer system capable of truly emulating the human sense of hearing especially when configured to reproduce the characteristics that exist between the external and internal human ear (with the actual auditory canal or 'meatus' that connects the ear drum to the outer ear having an average length of 27 mm) that functions as if it were an open organ pipe where its lowest resonating frequency would be 3181 Hz. It also emulates the human sense of balance linked to the sense of hearing, through the vibrations of the masses of the device's four prongs, that correspond approximately to the labyrinth within the internal ear, calibrating their dimensions to reproduce the states of motion or rest like in a human body that is subjected to the earth's gravity, is always capable of recognizing dimensional space, and in so doing enhancing all of the characteristics of the ears and adding it to others that would not otherwise be achievable. There is also the additional possibility of increasing the sensitivity of the device through the use of amplifiers/preamplifiers circuits (also using Integrated Circuits and Chips) specifically designed for eliminating interferences, and suppressing disturbing noises thanks to the use of four separate low voltage feeders connected to an equal number of separate supply apparatuses, which precisely guarantee the display of the tridimensional amplification of all electric parameters.

The investigation and analysis of materials and fluids by determining their chemical or physical properties, or the control of environmental parameters (geophysical measurements), may also require the use of: chromatic tuners, tuning range generators, or function generators (also with arbitrary wave forms), with the addition of one or two transmitters or beacons, also placed precisely opposite one another in relation to the fact that this device presents many similarities with the operating principles of a diapason (in which transmitters and/or beacons having the output characteristics of being detected by this device using: infrasonic, sonic, ultrasonic or acoustic waves, or combining several directional or non-directional signals for determining the presence, sense of direction or deviation from a predetermined direction of one or more objects simultaneously, providing a display or obtaining images thereof). Above all, in order to achieve this the use of computers is required for evaluating data, using analysis of electrical variables for objects/targets characterization, objects/targets signature and cross-sections (filtering out distortion with spectral manipulations, and using spectral analysis programs of graphic displays, or acoustic spectrography and spectroscopy, frequency spectrum analysis, frequency spectrogram analysis, 3-D spectral displays, resampling and resynthesis of signals in graphic displays, or sonometers). It is also possible using Real-Time performance systems comparing and analysing spectra of the signals received (with or without amplification) with sampling signals taken as reference by "subtracting" a new specified spectral signal from a current spectrum (also on a logarithmic scale) where each point in the resulting display represents the ratio of the spectral density between the same two points. In the statistical analysis of waveforms "autocorrelating" a spectrum is a very useful technique for studying and applying the periodicity of functions.

This device is also a system than can be used for recording sounds in stereophonic form whilst retaining at all times an unaltered and faithful tree dimensional reproduction of the sounds, that is always compatible with the binaural human perception of sound via earphones, audio head phones, speakers, loudspeakers, sound diffusers, from twin audio channel satellite radio and TV transmissions and so on. It is therefore compatible with all types of equipment currently in existence for recording, mixing, transmitting and reproducing sounds, or images with sounds (video, movie and much more). All audible sounds are audible from the extreme audible left to the extreme audible right, from the highest audible point to the lowest audible point, including the front and rear, always precisely defined. The possibilities also exist, by exploiting the technical characteristics of this resonator device, for recording inaudible sounds some of which can be heard through recognisable physical effects such as resonance or acoustic beats using two separate channels (FIGS. 13 and 15, Sheet 5/5). When used in industrial applications however, this resonator device can also exploit one channel where the compatibility with the binaural human perception of sound is not required. This device is in fact capable of identifying the direction from which a sound or signal originates using only one Left-type channel (that operates best in an anticlockwise direction) or Right-type channel (being specular to the other, operates best in a clockwise direction). A major characteristic of this type of industrial application is that it consists of Real-Time detection without the need to use any rotating parts (FIG. 12, Sheet 5/5). Also in this case the resonating device assumes only values of resistivity when it intercepts sounds for which it has been designed. It in fact renders the reactive values identical (inductive and capacitive) causing one to cancel out the other. At these frequencies, commonly referred to as resonating, this device behaves as though it were a perfectly ohmic transducer system. There are a several values of frequency at which a cancelling out of the total reactance value occurs, that corresponds to the minimal impedance value, and therefore maintaining the voltage values constant will result in an increment of the value of the current generated by this device at the output. It is also possible however, to produce particular configurations on the basis of required uses and applications.

TECHNICAL FIELDS OF THE INVENTION

In particular the device in accordance with the invention and the associated system configurable with it, can be used to detect sounds that, because of their specific frequency (ultrasonic or infrasonic waves), as well as their low intensity (less than 20 μPa at a frequency of 1 KHz corresponding with the low hearing threshold), remain inaudible to the human ear. These include, for example, the sound of a water droplet as it detaches itself from a dropper.

This resonator device can vibrate at more than one resonating frequency, in relation to the precise values for which its mechanical vibrating structure has been designed. It is in fact the same as the taut string (or vibrating string) of a pianoforte that is capable of vibrating at more than one frequency corresponding to the respective harmonics that are stationary waves of differing lengths and frequencies. This device's major quality does not rest with the different types of transducers with which it can be equipped (these transducers can in fact be of any type as long as they are able to convert the movements of the prongs—which support and hold them—into electrical signals when they resonate, with the addition of incremental vibrations for sound pressure in air) but rather in the quality and type of the structure that supports and holds them, and it is this that in particular constitutes the main content of this patent. This resonator device, more than any other transducer currently available, is in fact capable of intercepting and capturing pure sounds (fundamental harmonic or fundamental overtone or first partial) and in so doing can transform the maximum quantity of energy received into electrical signals.

The maximum amount of energy received must not therefore be dispersed in the form of sounds (therefore the careful choice of the materials used to manufacture the mechanical structure of this device becomes extremely important) and furthermore the mechanical structure must not interfere or interact with the sounds that surround this resonator device.

Furthermore, the device in accordance with the invention and the related system configurable with it allows the picking up of all sounds at their precise point of origin (azimuthal and zenithal angular localisation) and simultaneously present in one given environment (separation and distinguishing of the sound's sources), including the different and numerous points of origin of the jittering of dust particles or so called "background noise" caused by the environment but also due to molecules of gas (Brownian motion). They will remain separated even at the moment of listening, without one superimposing another.

The device, in accordance with the present invention, can also be used as a detector of geo-electrical signals (dust particles or cells that are stimulated and influenced by gravitational field and from gravitational wave sources) in gaseous or liquid environments in as much as the said device detects time domain amplitude and frequency variations in electric potential between two condensers (in particular when they have identical capacity values) at a constant charge when the membrane of one of the transducers moves with respect to the other (even in the absence of the effect of jittering on particles and molecules at temperatures of approximately absolute zero degrees).

A further advantage of this device is that it can be manufactured at very low costs and can therefore be fitted to audio, video, and movie equipment (both for amateur and professional use) and can be used as a tridimensional precision sound level meter or professional microphone and can also be employed in the manufacture of professional audio instruments, even at a very low cost. This is particularly useful in industrial applications e.g. quality control in automatic production, for detecting and locating masses and foreign bodies in foods, beverages, pharmaceuticals and in other applications where x-rays and microwaves would not be advisable, and so on. It specifically concerns a resonator device that is a configurable multi-purpose sound system that can be used for recording sounds in stereophonic form whilst retaining at all times an unaltered and faithful three dimensional reproduction of sounds, that is always compatible with the binaural human perception of sound. It could also find applications in, amongst other things: a) subaqueous uses as a hydrophone; b) for measuring vibrations and speeds; c) azimuthal and elevational guidance systems also with robotics; d) indicating positive or negative directions of a linear movement, or clockwise or anticlockwise direction of a rotational movement; e) for determining the presence of a target discriminating between fixed and moving objects; f) presence-detecting and visualisation of the interior of objects; g) neutralising some undesirable influences from terrestrial fields.

Human necessities: this resonator device is applicable in diagnosing and analysing biological material and in the field of therapy (recording and sampling in a way which requires outputs through transducers or elements placed on skin of the human body). It is particularly suited for therapies using several types of procedures in which recorded sound samples of a particular type of waves (infrasound and ultrasound) suitable for electromedical applications can be amplified (with the tridimensional amplifications of all electrical parameters), directed and concentrated according to the required use. The maximum available sonic energy is concentrated at the point where the two waves, emitted by the two frontal transmitters (positioned precisely one opposite the other, as shown in Sheet 5/5, FIG. 14), meet. What is more, with the use of two transmitters the possibility of controlling sonic energy is improved, enhancing the quality of the treatment and the power to destroy sick or abnormal cells without damaging others (sonic waves in the field of oncology are used for destroying the membranes and cytoskeletons of cells). Examples of some of the different types of applications are: infrasound, ultrasound therapy and massage; infrasonic, sonic and ultrasonic directional vibrations; localised ultrasound hyperthermia (over 40° C.); extracorporeal shock wave therapy. Further therapeutic uses could be: the neurobiology of learning, memory and meaning, treatments for increasing neurological functions, and electro-vibratory effects on body and brain, for treatments in physiology, psychology and psychophysiology.

These and other additional uses can be envisaged for this particular resonator device and circuits for 3-D detection and receiving of sonic waves, even of very low amplitude/frequency, in fluids, and suitable for use in cybernetics, with preamplifier circuits specifically designed for eliminating interferences and suppressing noises by four separate low-voltage supply feeders connected to an equal number of separate supply apparatuses, in order to also guarantee the device's real tridimensional displays in accordance with the present invention consisting of a slender cybernetic transducer system capable of truly emulating the human sense of hearing, enhancing all of its characteristics and adding to it others that would not otherwise be achievable.

BACKGROUND ART OF THE INVENTION

Introduction to the Particular Characteristics of This Device

Even if this invention is fitted with the same types of transducers used in similar devices, it cannot be directly compared with others, because, above all, it derives its particular and unique characteristics and performance from the fact that it vibrates, as does a diapason, "imitating" and "emulating" its physical properties. Furthermore, this transducer system can also be produced with a dedicated amplification circuit designed to transfer intact to the output all of the tridimensional parameters of the signals captured by the original (diapason-like) resonator device.

Several of the patents listed below represent a technology that is recognised as being state of the art in the field of tridimensional sound reproduction systems. The versatile device presented through this patent is characterized by the fact that when compared to previous concepts, shows how its technological configuration can be considered innovative and inexpensive. Above all it proves without doubt to be the most naturally suited in emulating the complexities found in human hearing when linked to the sense of balance that is subjected to earth's gravity and to the states of motion or rest in which the human body finds itself at the actual moment of perceiving sounds.

All of these characteristics and more (that have not even been mentioned) constitute the scientific principle on which this device is founded that above all others. This is in virtue of the fact that it does not require a dummy head (like for example the expensive Georg Neumann™ product KU100, a Dummy Head with a binaural stereo microphone that resembles the human head and has two microphone capsules built into the ears). This binaural reproduction is achieved without the need to resort to contrived dummy ears and pre-arranged mathematical algorithms (like for example the expensive Sennheiser™ products, Surrounder pro, and Lucas (Personal Home Theater Dolby Surround Prologic™), that incorporates a special Dolby™ decoder and has four individually driven loudspeaker systems for PC games and home theatre). It is also ideally suited for production at low costs, thanks to the presence of four identical cartridges which point precisely in the direction of the four cardinal points covering the physical space not only around but also inside the four transducers in all possible directions of origin of one or more audible or inaudible sounds.

It is a particular feature of this resonator device, consisting of four upright prongs or forks, or a 'double diapason' (or 'triple diapason', where it becomes possible to consider the production of a third diapason for the existence of a horizontal axis of contiguousness between the internal of the left and right hand prongs of the two diapasons), that each prong is specifically turned with its detection surface pointing in the direction of its own cardinal point (so that one faces North, one West, one South, and the other East, in an anticlockwise or clockwise direction in 90° steps).

BACKGROUND ART OF THE INVENTION

Relating to the Field of Sound Transducers Intended for Binaural Listening That is Characteristically That of Human Beings 1) THE RECORDING AND REPRODUCTION OF WAVER PATTERNS (PCT/CA95/00336) International Publication Number: WO 95/35012—International Publication Date: 21 Dec. 1995

Applicant and Inventor: Saretzky, Eric.

This describes the classical method of recording and reproducing audible sound directly through loudspeakers only in a realistic and precise manner, but that excludes geo-electrical effects and infra-acoustic (infrasounds) and ultra-acoustic (ultrasounds) elements of sound, and which requires a great number of perfectly synchronized channels.

2) DIRECTIONAL HEARING AID

Patent Number: U.S. Pat. No. 4,751,738 Date of Patent: 14 Jun. 1988

Inventors: Brearley, Maurice N. and Widrow, Bernard.

This constitutes the first truly valid prototype of a monophonic device not yet influenced by geo-electric effects in any specific way. This device is improved upon in U.S. Pat. No. 5,793,875, but only with respect to the objectives set: i.e. to assist the hard of hearing to be able to achieve even directional hearing in:

3) DIRECTIONAL HEARING SYSTEM

Patent Number: U.S. Pat. No. 5,793,875 Date of Patent: 11 Aug. 1998

Inventors: Widrow, Bernard and Lehr, Michael A.

4) No title available.

Patent Number: FR 2501448 Publication date: 10 Sep. 1982

Applicant and Inventor: Chesnard, Henri.

Where a sound recorded normally is reproduced in holophonic form (i.e. virtually but not really recorded in three dimensions).

Such a methodology will not achieve significant results as can be deduced from:

5) RECORDING AND PLAY BACK TWO-CHANNEL SYSTEM FOR PROVIDING HOLOPHONIC REPRODUCTION OF SOUNDS

International Publication Number WO 98/07299—International Publication Date: 19 Feb. 1998 Applicant and Inventor: Finsterle, Luca Gubert.

6) OMNIDIRECTIONAL SOUND FIELD REPRODUCING SYSTEM

Patent Number: U.S. Pat. No. 3,824,342 Publication Date: 16 Jul. 1974

Inventors: Christensen, Roy Martin; Gibson, James John; Le Roy, Linberg Allen.

Develops a methodology for picking up and reproducing in quadraphonic form using three channels; less efficient than 1) but more practical whilst still introducing certain inaccuracies in the directional reproduction and greatly limiting the space available to the listener for perfect listening,

7) A STEERABLE AND VARIABLE FIRST-ORDER DIFFERENTIAL MICROPHONE ARRAY

Patent Number: U.S. Pat. No. 6,041,127 Date of Patent 7 Oct. 1998

Inventor: Elko, Gary Wayne.

An extremely accurate device for pinpoint picking up but that does not appear to be particularly suited to human binaural hearing.

This next device appears to be a decided improvement, even though unsuitable for binaural listening (which was on the cutting edge in 1977):

8) COINCIDENT MICROPHONE SIMULATION COVERING THREE DIMENSIONAL SPACE AND YIELDING VARIOUS DIRECTIONAL OUTPUTS

Patent Number: U.S. Pat. No. 4,042,779 Publication Date: 16 Aug. 1977

Inventors: Craven, Peter Graham and Gerzon, Michael Anthony.

9) The following are to a certain extent less pertinent than the ones listed above:

| | | |
|---|---|---|
| Patent Number: | US 4536887 | (Publication Date: 20 Aug. 1985) |
| Patent Number: | US 4703506 | (Publication Date: 27 Oct. 1987) |
| Patent Number: | US 4752961 | (Publication Date: 21 Jun. 1988) |
| Patent Number: | EP 0690657 | (Publication Date: 03 Jan. 1996) |
| Patent Number: | US 5581620 | (Publication Date: 03 Dec. 1996). |

Devices that are in no way pertinent using the following artificial and contrived methodologies such as this:

| | | |
|---|---|---|
| Patent Number: | US 5583962 | (Publication Date: 10 Dec. 1996) |

that irreparably and in a contrived way alters signals that are truly tridimensional (in this case it would be more accurate to speak of virtual three dimensionality rather than real). Such as for example in:

| | | |
|---|---|---|
| Patent Number: | US 3800088 | (Publication Date: 26 Mar. 1974). |

BACKGROUND ART

Relating to The Field of Recognising and Analysing Objects (also by means of one of more sound sources)

It is also necessary to make reference to the state of the art of another type of device (even if it does not make use of sonic waves) that is designed for investigating and analysing materials and fluids, or also requires the use of beacons to locate the position or identify the shape (or both) of specific objects or targets. This second and specific field of application for the resonator device does not restrict the previous application in any way, and means that the device being presented in this patent could just as easily be used as an activated interception diapason. The devices, considered state of the art, where their details particularly relate to other methods and methodologies which are currently known about and used in various sectors, and are quoted here as examples:

10) U.S. Pat. No. 3,811,782—METHOD AND APPARATUS FOR MEASURING THIN FILM ABSORPTION AT LASER WAVELENGTHS in which a pressure measuring instrument, such as a capacitance microphone, is connected to measure the pressure of a gas in the chamber.

11) U.S. Pat. No. 3,887,896—ACTIVE SONAR IMAGE PERCEPTION with a binaural handset for locating the source of the acoustic echo.

12) WO 9847022—DOPPLER RADAR WARNING SYSTEM for determining the distance between a target and the receiving antenna.

13) U.S. Pat. No. 5,386,082—METHOD OF DETECTING LOCALIZATION OF ACOUSTIC IMAGE AND ACOUSTIC IMAGE LOCALIZING SYSTEM in which an acoustic impulse is emitted from a sound source to a dummy of a human head.

14) U.S. Pat. No. 5,622,172—ACOUSTIC DISPLAY SYSTEM AND METHOD FOR ULTRASONIC IMAGING where an ultrasonic imaging system has a tridimensional acoustic display using Head Related Transfer Functions (H.R.T.F.).

15) GB 2204402—AUDIO LOCATION OF A SOUND SOURCE where the output signals are compared during the rotation of two microphones that may be mounted on the outside of a helmet.

16) DE 3528075—METHOD AND DEVICE FOR STEREO-ACOUSTIC HIT POSITION MEASUREMENT OF PROJECTILES which uses a minimum of six microphones, protected by a mound, in the proximity of the target.

17) JP2001296350—DETECTION/ESTIMATION METHOD OF SOUND RANGING SENSOR AND APPARATUS THERE-FOR that measures a propagation loss of a plurality of points and a sound velocity.

BRIEF DESCRIPTION OF DRAWINGS (5 SHEETS, 15 FIGURES)

Key (5 Sheets of Drawings, 26 Drawings, from FIG. 1/a to FIG. 15/b)

L=left channel or left side for recording or playing ultrasonic, sonic and infrasonic waves and vibrations;

R=right (channel/side or direction of sound);

J=left channel—equivalent to left channel in FIG. 9/a and FIG. 10 (Sheet 4/5); with frontal perception precisely defined by "N" and "E" transducers;

K=right channel—equivalent right channel in FIG. 9/a and FIG. 10 (Sheet 4/5); with frontal perception precisely defined by "N" and "E" transducers;

J=equivalent to right channel (Sheet 4/5 FIG. 11) with the frontal perception precisely defined by "W" and "S" transducers;

K=equivalent to left channel (Sheet 4/5 FIG. 11) with the frontal perception precisely defined by 'W' and "S" transducers;

N=North orientation of transducer capsule from which it principally captures waves and vibrations (that corresponds to the Front-Left direction in Sheets 1/5, 2/5 and 3/5), that is always paired with the W transducer, and as a result of this both the transducers are equivalent to a Left-type human ear;

W=West orientation of transducer capsule from which it principally captures waves and vibrations (that corresponds to the Rear-Left direction in Sheets 1/5, 2/5 and 3/5, that is always paired with the N transducer);

E=East orientation of transducer capsule from which it principally captures waves and vibrations (that corresponds to the Front-Right direction in Sheets 1/5, 2/5 and 3/5), that is always paired with the S transducer, and as a result of this both the transducers are equivalent to a Right-type human ear;

S=South orientation of transducer capsule from which it principally captures waves and vibrations (that corresponds to the Rear-Right direction in Sheets 1/5, 2/5 and 3/5, that is always paired with the E transducer);

G=Ground/grounding (or negative pole of the electronic circuit);

+=Positive terminal of the sound transducers or separate low voltage feeders (positive pole) of the electric circuit;

C=Condenser with a precise capacitance;

R=Variable resistance, potentiometer or precision trimmer (for controlling frontality);

A=Amplifier/Preamplifier with separate low voltage feeders connected to a separate supply apparatus;

IC=Single integrated circuit with two separate low voltage feeders (an original system of tridimensional preamplifiers developed for this device);

Front/Rear=front or rear origin/direction of the acoustic waves or vibrations (Sheet 5/5, FIGS. 12 and 15/a);

Looking Direction=direction in which the front of the head/device is facing;

Note: the symbols relating to the "N" (referred to Front-Left), "S", "B" and "W" (white on black ink) identify the transducers on the basis of the conventional direction in which they are facing (cardinal points).

The resonator device consists of a system having several transducers (see FIG. 8) appropriately fitted and spatially aligned on corresponding support structures than can be likened to the arms or prongs of a tuning fork (see FIG. 9/b and FIG. 9/c). This structure can be compared to two tuning forks placed side by side with the four prongs facing four different ways, arranged at 90° angles one from the other in a clockwise or anti-clockwise direction (see FIGS. 1/a and FIG. 4/a), with the distance between the individual prongs being set according to requirements, and the height (of the four prongs) also being variable depending on the required use. In this way it is possible to achieve numerous interacting operational set-ups on the basis of the different uses, as illustrated for reference purposes, but in no way restrictive, in the enclosed five drawing Sheets which include:

Sheet 1/5

In the first production model the frontal reception is determined by the N and E transducers, where the N transducer is externally positioned on the left side and is always pointing in one direction, defined as Front-Left; on the other, right-hand side, the E transducer undertakes the same function, and is always defined as Front-Right; the W transducer, defined as Rear-Left, is always electrically paired with the N transducer, whilst the S transducer, defined as Rear-Right, is always electrically paired with the E transducer;

FIG. 1/a shows a simplified configuration of a first type of this resonator device;

FIGS. 1/b, 1/c, 2/a , 2/b, 3/a and 3/b show the electric and electronic circuits for the configuration illustrated in FIG. 1/a.

Sheet 2/5

In this second configuration the frontal reception is determined by the B and N transducers, where the N transducer is internally positioned on the right side and is always pointing in one direction, defined as Front-Left; on the other, left-hand side, the E transducer undertakes the same function, and is always defined as Front-Right; the W transducer, defined as Rear-Left, is always electrically paired with the N transducer, whilst the S transducer, defined as Rear-Right, is always electrically paired with the E transducer;

FIG. 4/a shows a simple configuration of a second type of this resonator device (where the left timing forks of FIG. 4/a correspond to the right tuning forks in FIG. 1/a and obviously the right timing fork in FIG. 4/a corresponds to the left tuning forks in FIG. 1/a);

FIG. 4/b, FIG. 5 and FIG. 6 show the electric and electronic circuits referred to, in the simplified model illustrated in FIG. 4/a;

FIG. 6 shows an example of the use of two Integrated Circuits that can also be contained in one Chip.

Sheet 3/5

In this third configuration the frontal reception is determined by the N and E transducers, where the N transducer is externally positioned on the left side and is always pointing in one direction, defined as Front-Left; on the other, right-hand side, the E transducer undertakes the same function, and is always defined as Front-Right; the W transducer, defined as Rear-Left, is always electrically paired with the N transducer, whilst the S transducer, defined as Rear-Right, is always electrically paired with the E transducer, with the fact that the N and S left hand side transducers are very close to one another as are the B and W transducers on the right hand side;

FIG. 7/a shows an example of a configuration of a third type of this resonator device viewed from above;

FIG. 7/b shows two examples of electronic circuits for the third type of production model in FIG. 7/a;

FIG. 8 shows in an enlarged form the exact matching for every single frontal membrane or diaphragm located in the capsules of the four transducers in respect of the simplified form in FIG. 7/a (highlighting their perfect vertical axis correction for centering the four frontal receiving membranes).

Sheet 4/5

In this fourth configuration the frontal reception is determined by the N and B transducers, where the N transducer is positioned on the left side and is always pointing in one direction, defined as Front-Left; on the other, right-hand side, the E transducer undertakes the same function, and is always defined as Front-Right; the W transducer, defined as Rear-Left, is always electrically paired with the N transducer, whilst the S transducer, defined as Rear-Right, is always electrically paired with the E transducer, with the fact that the N and S left hand side transducers are on the same resonating/vibrating prong as are the E and W transducers on the right hand side;

FIG. 9/a shows a configuration of a fourth type of resonator device with the three extremely simplified views of two prongs of the tuning forks shortened in height (viewed from above in FIG. 9/a, from the front in FIGS. 9/d and 9/e, and from the side in FIGS. 9/b and 9/c);

FIG. 10 and FIG. 11 show two opposite electronic circuits for the same type of simplified configuration in the three views from 9/a to 9/e.

Sheet 5/5

FIG. 12 shows in a simplified form the angular collation on the azimuthal and zenithal axis for two transducers inserted on the top of the two prongs specifically designed to intercept sample signals also with only one left or right tuning-fork (FIG. 12 only shows the left channel from the example in FIG. 1/a)as an example of a fifth production model for the investigation and analysis of materials and fluids or the control of environmental parameters, and also used to locate the exact position and identify the shape and structure of specific objects.

FIG. 13 specifically concerns an application of this system that can be used for recording and reproducing sonic waves, retaining at all times a tridimensional reproduction of sounds that is always compatible with the binaural human perception, through two speakers (or a series of speakers);

FIG. 14 shows the detail of two transducer emitters of ultrasonic, sonic and infrasonic waves and vibrations with the drawing of the paths taken by the sounds emitted by these (for use in industrial and pharmaceutical applications, but above all in the electromedical field for investigating and analysing); also using this resonator device as a transducer and amplifier of sampled sound waves in a tridimensional form that can then be directed and concentrated in an internal point of the human body according to the required use.

FIG. 15/a and FIG. 15/b both show a view from above of an audio headphone system and the same system viewed from the rear, with the tridimensional extension of the sounds received being highlighted (where in-head localization of a sound is a disturbance that has been eliminated but can also be produced as one of many possible effects).

As the enclosed drawings show, and the key of the terminology and symbols used also highlights, the resonator device and its electronic circuits for 3-D detection and receiving of ultrasonic, sonic and infrasonic waves, even of very low amplitude and frequency, in the atmosphere and in fluids, and suitable for use in cybernetics and laboratory uses, in the form of a slender transducer system of sound waves that can be recorded, amplified, directed and concentrated in tridimensional form, according to the required use in accordance with the present invention is characterized by the fact that it includes two pairs of transducers (the N, W pair corresponding to a Left-type human ear, and operates best with sounds from an anticlockwise direction, whilst the E, S pair corresponding to a Right-type human ear that, being specular to the other, operates best with sounds from a clockwise direction) appropriately mounted and spatially adjusted on corresponding and appropriate slender support structures like the prongs of two tuning-forks placed side-by-side with resonating masses that have the transducers on the prongs, with the distance between the individual prongs, their dimensions, shapes and masses being set accordingly, in order to receive vibrations and resonances at predetermined frequencies, so these electrical/electronic transducers can in fact be of any type as long as they are able to convert vibrations into electrical signals, for sounds that have been captured in air or water with the addition of incremental vibrations for the resonating movements of the prongs which support and hold them; this is possible for example with a well known or custom made pressure gradient type microphone cartridges, fitted singly together with its related components, on individual supports made of materials that will not create interference with the desired frequencies and arranged in pairs on a common base or singly, it is also possible to design this resonator device by using, where necessary, some of the already established techniques used in the field of designing diapasons.

BEST METHODS FOR CARRYING OUT THE INVENTION

When Configured to Reproduce the Human Sense of Hearing Like a Slender Cybernetic Transducer System in the Atmosphere (the following is just one example)

The electronic circuits that are a very important part of this device require optimum shielding, in view of the fact that the device itself does not have the ground as its sole point of reference. The shorter the electrical pathways to reach the outlets, the greater will be the quality of the signal obtained. The standards for achieving a good shielding are well known and the means for producing these require the use of, for example, silver or gold plated leads and wires or those that have excellent quality characteristics.

The electrical connection between two pairs of capsules or transducers in particular, and all those that go to make up the transducer system, and the carrying structure with the prongs for capturing sonic waves and vibrations and the tridimensional amplification systems are aligned symmetrically one from the other, with the two left side transducers (together with their electrical/electronic circuits, prongs and all other parts) always mirroring those on the right.

The configurations of the system are determined by recalling the characteristics that exist between the external and internal human ear where the actual auditory canal or 'meatus' that connects the eardrum to the outer ear has an average length of 27 mm, and therefore if it is to operate precisely as an open organ pipe, its lowest resonating frequency in air would be:

$$f_R = \frac{c_{SUONO}}{4\lambda} = \frac{343.59}{4 \cdot 0.027} = 3181 \text{ Hz} \qquad \text{(Formula 01)}$$

where $f_R$=resonating frequency fixing a predefined ambient temperature, or a temperature range within which it is envisaged the device should operate, so that it will refer exactly to a velocity of propagation of the sound energy ($c_s$) and therefore:

$$t=20°\ C.=68°\div 69°\ F. c_s=34{,}359 cm/sec \quad \text{(Formula 02)}$$

the average propagation time ($t_o$) for this energy to travel 1 cm is indicated by:

$$t_O = \frac{s}{c_s} = 29.1044 \cdot 10^{-6}\ sec \quad \text{(Formula 03)}$$

in so doing $t_o$ and the resonant frequency of the human ear taken as a reference are obtained. The period "T" (in seconds) is then obtained, i.e. in a graphic sense, the time taken by the sine curve to accomplish its shape undertaking a period (a rotation of 360°, i.e. one rotational angle) at the frequency taken as a reference, i.e. 3181 Hz:

$$T_R = \frac{1}{f_R} = 314.366 \cdot 10^{-6}\ sec \quad \text{(Formula 04)}$$

where $T_R$=period corresponding to the resonant frequency subsequently the maximum separation distance ($d_{MAX}$) between the two transducers that form any of the device's pairs (for example N-W for the left hand pair, E-S for the right hand pair as in FIG. 1/a, Sheet 1/5) has to be obtained. On the basis of the above specified parameters taken as a point of reference, this maximum distance is applies to all four of the system's basic configurations:

$$d_{MAX} = \frac{T_R}{t_O} = 10.8\ cm \quad \text{(Formula 05)}$$

where, if the frequency $f_R$ is increased the $T_R$ period decreases and therefore the maximum separation distance $d_{MAX}$ will decrease its value (in centimeters).

However, even if the frequencies higher than 16,000 Hz (16 KHz) are usually too high to be detected by the human ear, the upper limit for these acoustic frequencies (ultrasonic waves) is almost limitless, and can be extended to well in excess of 10,000,000 Hz (10 MHz). The minimum separation distance between the two transducers of a single pair at 16 KHz (in the field of sonic waves in air) will therefore be:

$$d_{MIN}=2.14cm \quad \text{(Formula 06)}$$

so that, for frequencies capable of being perceived by the human ear, the separation distance between the two transducers of a single pair will range from 2.1 cm (but this lower value may be halved for particular types of applications) and 10.8 cm, and can be produced from a single pair (i.e. one channel) of N-W type (corresponding to a Left-type human ear, that operates best with sounds from an anticlockwise direction) or a single pair of E-S type (corresponding to a Right-type human ear, that being specular to the other, operates best with sounds from a clockwise direction) when used in industrial applications, and also with two pairs for binaural listening.

Using pressure gradient type microphone cartridges or capsules, the distance between the N and S transducers will correspond to the distance between the E and W transducers (FIG. 1/a, Sheet 1/5), and can be selected at will, even if, in order to remain at the level of the audible sounds, this distance must be less than or equal to:

$$d_{N-S}=d_{E-W}\leqq 4d_{MAX} \quad \text{(Formula 07)}$$

where $$4d_{MAX}=4\cdot 10.8=43.2cm \quad \text{(Formula 08)}$$

in which the multiplying factor 4 is to be placed in relation to the same value chosen previously with λ in Formula 01:

$$f_R = \frac{c_{SUONO}}{4\lambda} = \frac{343.59}{4 \cdot 0.027} = 3181\ Hz \quad \text{(Formula 01)}$$

Where the device operates in the atmosphere or, when surrounded by a gas, at 20° C. a further advantage is that the distance between the two outer N and E transducers can be selected at will, even if, in order to remain at the level of audible sounds, the distance can be less than or equal to:

$$d_{N-E}\leqq 5d_{MAX} \text{ corresponding to } 54cm \quad \text{(Formula 09)}$$

The optimum separation between the left and right channels, where the sonic waves are to be listened to directly by human beings, is achieved on the basis of the following rules:

$$d_{S-W}\leqq d_{N-W} \quad \text{(Formula 10)}$$

better still if:

$$d_{S-W}>>d_{N-W} \quad \text{(Formula 11)}$$

BEST METHODS FOR CARRYING OUT THE INVENTION

Like a Slender Cybernetic Transducer System Immersed in Water (an example of an application)

The above explanation only applies when the device operates in the atmosphere or when surrounded by gas, fixing a predefined temperature. From the relationship between the propagation speed of electroacoustic energy in water (at 20° C.) and in air (at 20° C.) the following is obtained:

$$\frac{c_{S(WATER)}}{c_{S(AIR)}} = \frac{1510}{343.59} \cong 4.395 \quad \text{(Formula 12)}$$

This means that in parity with the resonating frequency taken as a reference in this example for water, all the dimensions, shapes, masses and distances between the transducers will be 4.395 greater than those calculated for the use of the same device in air:

$$d_{MAX(WATER)}=D_{MAX(AIR)}\cdot 4.395\cong 47.47cm. \quad \text{(Formula 13)}$$

BEST METHODS FOR CARRYING OUT THE INVENTION

An Example of an Application in the Field of Geophysics, Gravitational Measurement and also For Detecting Masses or Extremely Small Objects The device in accordance with the present invention can also usefully be deployed as a detector of geo-electrical and gravitational signals in a liquid, air or gaseous environment, in as much as the device detects amplitude and frequency variations in the electric potential between two condensers (also having identical values) at a constant charge when the membrane or diaphragm of one of the transducers moves with respect the other (even in the absence of the effect of jittering on air particles or movement of water molecules). However, even in the absence attribution of gravitational excitation, electrical signals are always present at 20° C. because they originate from thermal jittering (Brownian motion). Therefore, in order to obtain reliable results it will be necessary to bring the device to an extremely low temperature that is as near as possible to absolute zero. In order to allow this type of device to operate under such difficult conditions (even if it may not always be necessary to bring the device itself to such low temperatures) the use of special materials is advisable in their construction, such as 5056 aluminium, silicon, sapphire and niobium (that has superconductor properties to the temperatures of liquid helium). Amplifiers and preamplifiers in this case employ transistors that take advantage of the Josephson effect or with SLUG junctions that use a niobium wire with drops of lead and tin soldering. Other more developed control devices are also capable of improving time domain amplitude and frequency detection of geo-electrical waves induced by gravitational signals.

When designing a similar transducer system the frequencies to be taken as a point of reference range from less than 1 Hz up to a maximum of several KHz and these electrical signals are sent mainly to detection and measuring devices. In order to calibrate the detector, the frequency to which to refer to as a point of reference is around 1000 Hz; a frequency with d=34.359 cm, that is also a point of reference for the human sense of hearing and balance, and therefore this transducer system lends itself to dual use, obviously with different types of construction materials. Furthermore, this device will operate without any restrictions to the bandwidth.

The above observations and the results obtained from practical experimentation, show that what Albert Einstein claimed in "Über Gravitationswellen" (König, 1918, page 154), i.e. "The gravitational waves that can be generated by objects in motion, in a laboratory, produce very weak effects on other objects with a virtually negligible value in all imaginable cases" ought not, on the whole, be totally correct. In reality what has been discovered is that these gravitational waves, in order to be able to propagate in the surrounding space, at a speed equivalent to light, extract energy from mass. This reasoning, the experiments performed and the need to produce a more precise description of what takes place when adding speeds that are near to that of light, has resulted in my producing with this formula:

$$v = \frac{v_1 + v_2}{1 + \sqrt[19]{\left(\frac{v_1 v_2}{c^2}\right)^{31}}} \qquad \text{(Formula 14)}$$

Adding speeds that are in competition to that of light, the above formula proves to be more accurate than Einstein's theorem of addition of the speed in relativistic physics, first phase:

$$v = \frac{v_1 + v_2}{1 + \frac{v_1 v_2}{c^2}} \qquad \text{(Formula 15)}$$

If it is accepted that the new formulation (Formula 14) is reasonable, this leads to the consequent modification of all the formulae that go to make up the Lorentz group of transformations, more correctly referred to as Einstein-Lorentz. The intention is not that of bringing into question the actual principle of relativity, which presupposes that all inertial systems are equal amongst themselves. Several laws of physics ought to be re-examined so that they will conform to the Einstein-Lorentz group of transformations modified by the Formula 14.

A comparison between the two formulas (n°14 with n°15) will also make the results possible with:

$$\sqrt[19]{\left(\frac{v_1 v_2}{c^2}\right)^{31}} > \frac{v_1 v_2}{c^2} \qquad \text{(Formula 16)}$$

DISCLOSURE OF INVENTION

Detailed Description of First Configuration (sheet 1/5)—Set Up and Simplified Electrical Circuit (FIGS. 1/a, 1/b, 1/c)

In the first production model, as shown in FIG. 1/a, Sheet 1/5, the N, W, S and E transducers are arranged in such a way that they represent the point of listening of a human head (a shown in the figure) with an operational point of reference consisting of a "front" (looking direction), a "rear" (back of the head) and two sides (L=Left and R=Right) with the pairs of transducers arranged on the sides, and where the four transducers are all pointing towards different points of space, at 90° angular distances from one another, and corresponding, as a reference, to the four cardinal points, establishing a choice for all the configurations (therefore for this one, but also for all the others mentioned for reference purposes), an identical point of reference, indicated by N=North. In this first configuration the transducer marked N is ideally pointed towards North (in one direction defined as Front-left) so that it will receive from that precise direction those signals emanating directly from there (and obviously also a part of those in the surrounding spaces) and the other transducers point W=West, S=South and E=East respectively, so that all four will cover a horizontal (azimuthal) plane of 360° (90°×4). This device is even capable of recognising the elevation of sounds with respect to a zenithal plane, which means that it can intercept sounds within an ideally spherical system. In this first configuration also, the pair of left (hand) transducers (L) is the one having a common ±45° pointing exactly in a leftwards direction, whilst the other pair (R) mirrors it exactly. The distance between N-W will be approximately the same as that between E-S whilst the distance between W-S will be greater than that between N-W (or E-S). It follows therefore that in order to achieve an anticlockwise revolution starting from North, will mean passing through W (−90° from N), then S (−180° from N), then finally through S (−270° from N), eventually returning to N.

The electrical connection between the two transducers that go to make up each of the system's two pairs applies to all of the possible configurations. With two identical or similar transducers (i.e. both being electrically compatible), identified and having chosen (also by convention) the contact points defined as positive pole, it will be necessary to connect to one another the two positives of the transducers that go to make up the first positive pair, that is to say for the L=Left (FIG. 1/b). The same identical operation will be performed on the other chosen pair, that is to say for the R=Right (FIG. 1/c). It is important to bear in mind that where all four transducers are not identical it must be remembered that N will be equal to E whilst W should be equal to S. Once the positives from each pair have been connected to one another, the negative contacts from the N and E transducers will be wired to ground (that for this reason, in the absence of resistors and capacitors, will be capable of frontal reception) whilst the other two remaining contacts will make up the outputs to send the one defined as W to channel 1 (L-Left), whilst the S negative will constitute the channel 2 output (R=Right). It is obviously also possible to have following type of connections (that will no longer be quoted again, in as much as it represents another practical way of constructing the same type of device): i.e. the two negatives from each pair of transducers having been connected to one another, the positive contacts that form the W and S transducers will be wired to ground, whilst the other two remaining positive contacts will make up the outputs to send the one defined as N to channel 1 (left) whilst the E positive will constitute the channel 2 output (right); and it is for this reason that they are capable of front perception. This methodology has neither been described nor illustrated in as much as it is simpler to realise and is not particularly suitable for use with condensers: this type of electronic circuit is usually achieved by giving the prevalence of the N and E signals (that have no condensers at their terminals and are therefore intended for frontal perception) over the W and S signals (that have a low resistance at their terminals). The same thing should be required with the preamplification circuits (FIGS. 3/a and 3/b).

The advantage, in the cases used here as an example, is that this device for sonic wave applications can be produced by using four pressure gradient microphone cartridges (i.e. omni directional), commercially referred to as High Quality Electret Microphone Cartridges, which are also much reduced in size, and easily purchasable (even at very low prices).

DISCLOSURE OF INVENTION

Cartridges For Sonic Wave Applications (For Example: Microphonic Applications of This Device)

Where electrect or condenser microphone transducers are used (that have a relatively high output level), the use of an internal preamplifier is envisaged; it is mounted in the vicinity of the backplate, it will function as an impedance adaptor. In addition to this, these pressure sensitive microphones requiring voltage gain, will have FET (Field Effect Transistors) internally with an "n" type channel (n-channel) commonly referred to as N-FET, and consequently in this case the Drain contact at the output from the N-FET will correspond with the positive of the microphone cartridge, whilst the Source contact will correspond to the negative. As an alternative, transistors that use Josephson junctions can be used which will improve the sensitivity for amplitude and frequency detection of sonic waves and of other types of signals.

DISCLOSURE OF INVENTION

First Configuration (Sheet 1/5): Main Electronic Circuit (FIGS. 2/a and 2/b)

FIG. 2/a and FIG. 2/b (Sheet 1/5) shows the same circuit as in FIG. 1/b and in FIG. 1/c with the addition of a condenser at the "W" and "S" terminals, a variable resistor at the "N" and "E" terminals, and in which these resistors (R) and the negative contacts of the microphones connected to ground determine the frontal pick up of these transducers. Metallized polycarbonate type capacitors should preferably be used, i.e. a Plastic Metallic Film type having self-generating properties, also suitable for short time impulses and with low losses at high frequencies; the connecting cables in these capacitors will be parallel and mechanically resistant to vibrations and are totally tropicalized. The variable resistor (R) is designed to calibrate and centre the frontality of each channel.

DISCLOSURE OF INVENTION

First Configuration With Dedicated Tridimensional Amplification of All Electric Parameters (SHEET 1/5, FIGS. 3/a and FIG. 3/b)

A preamplification and/or amplification device that will require its own power supply is also envisaged. There is also the additional possibility of increasing the sensitivity of the device through the use of amplifiers/preamplifiers with two circuits specifically designed for eliminating the interferences, and suppressing noises thanks to the use of four separate low voltage feeders connected to an equal number of separate supply apparatuses, which precisely guarantee the display of the tridimensional amplification of all electric parameters. For non-tridimensional operations, it is possible to use unified power supply systems or one low voltage feeder per channel. The investigation and analysis of materials and fluids or the control of environmental parameters (geophysical measurements), may also require the use of computers. It is possible in Real-Time to compare the signals received (with or without amplification) with sampling signals taken as a reference. Thanks to the extreme innovativeness of this electrical circuit it becomes evident that it can be adapted and developed in order for it to be used in numerous other applications, to increase noticeably the fidelity of the amplified output signal of real tridimensional sounds as picked up by the transducers on each of the channels.

DISCLOSURE OF INVENTION

Simple Conversion From First Configuration to Second Configuration and Vice Versa (Sheets 1/5 and 2/5)

In the first configuration of transducers shown in the example that appears in Sheet 1/5, sending the pair N-W to the right-hand side and R channel, and the other pair of transducers E-S to the left side and L channel it results in the second configuration shown in Sheet 2/5 that favours a near frontal perception of sounds. Then it is also possible to exchange the two capacitors (C) with the two variable resistors (R) to increase the perception from the W and S transducers (through the two resistors connected to their terminals) over the N and E signals. This one possible example, of many, shows how this transducer system is totally adaptable and how, precisely because of its versatility and practicality, it can be easily marketed in 'kit form'; it can as a consequence be quickly transformed in all the possible configurations so as to be adapted for a variety of uses and the capabilities of the technical user, without incurring any additional cost.

DISCLOSURE OF INVENTION

Device Configuration Two (Sheet 2/5)

In this second configuration of the production model, shown in FIG. 4/a (Sheet 2/5), the E-S and N-W transducers are facing in such a way as to capture sounds originating from within the system, and this is achieved by connecting the E-S pair to the L Channel, in fact present a common ±45° facing rightwards, and it is the opposite for the N-W pair, in this way creating a system that is particularly suited for highlighting and amplifying sounds that have been picked up and intercepted originating from positions that are at a particularly close range, in which (FIG. 5, Sheet 2/5) the variable resistors (R) also determine the frontal pick up of the E and N transducers. The overall result is a sophisticated system for recording samples of pure sound that is capable, even in the absence of any type of electronic amplification system, of capturing and sampling sounds of a very low amplitude and frequency also for electromedical applications or for use in the study of sonic propagations in fluids or physical phenomena. In this second configuration the four transducers are arranged in such a way that they can ideally perform one complete anticlockwise rotation starting from S, and in 90° steps, passing first through E, then N and finally through W, returning to S (in four precise steps).

Also in this basic configuration, the four (two plus two) transducers in FIG. 4/a (Sheet 2/5) are still paired with a shared positive, and the E and N transducers that have the negative contact to ground (which is the principle factor that determines the frontality for this type of electronic circuit), are intended for frontal pick up (Sheet 2/5, FIG. 4/b).

The circuit shown in FIGS. 1/b, 1/c, and 4/b also envisages two variable resistors (connected at the terminals of the transducer E and N in FIGS. 2/a, 2/b, and 5) suitable for adjusting the centering of the system's frontality. Furthermore the device can also operate without any type of internal power supply system and so is therefore adaptable for use with even the smallest and lightest of portable systems that use plug-in power transducers. It can also be used as a measuring instrument even when it is connected to an audio recording device (plug-in power circuits on Sheet 2/5, FIG. 5).

Moreover, a circuit such as that shown in FIG. 5 envisages a preamplification system with four separate low voltage power supply apparatuses and with separate low voltage feeders from each of the amplifiers, where it is also possible to use special types of Integrated Circuits specifically designed for this transducer system (Sheet 2/5, FIG. 6).

DISCLOSURE OF INVENTION

Device Configuration Three (Sheet 3/5)

In a third type of production model, shown in FIG. 7/a (Sheet 3/5), derived from FIG. 1/a (Sheet 1/5), the N, W, E and S transducers are arranged as follows: the left (L) hand pair consisting of the N and W transducers is place almost so that it superimposes the pair consisting of the B and S transducers, moving the N transducer nearer to the S transducer and the E closer to the W, retaining the initial direction of all of the transducers, whilst reducing the overall size of the device, thanks to the drawing closer together of the two support bases or the use of one common base having four prongs.

For the configuration shown in FIG. 7/a (Sheet 3/5) in particular, the basic version of the electronic circuit is that shown in FIGS. 2/a, 2/b and 3/a, 3/b in Sheet 1/5 with the frontal signal produced from the N and E transducers. There is also the possibility of exchanging: i) the capacitors with the resistors; ii) the polarity; iii) the Left with the Right channel; in both the electronic circuits of FIG. 7/b in order also to pick up the frontal signal from the W and S transducers (in this case B and N transducers pick up sounds originating the mainly from the rear).

DISCLOSURE OF INVENTION

Device Configuration Four (Sheet 4/5)

In a fourth production model shown in FIG. 9/a (Sheet 4/5), the N, W, B and S transducers are placed together on just two support structures that can be likened to the arms or prongs of only one tuning fork, where N will be above S (or vice versa) and E will be above W (or vice versa)

Also for the configuration shown in FIG. 9/a (Sheet 4/5), the basic version of the electronic circuit is that shown in FIGS. 2/a, 2/b and FIGS. 3/a, 3/b (Sheet 1/5). This fourth configuration derives directly from FIG. 7/a (Sheet 3/5). The electronic circuit is illustrated in FIG. 10 and can be easily changed over in the circuit shown in FIG. 11, transforming the two front transducers (N and B) into the two rear transducers (or vice versa), with the possibility, in so doing, of adapting the device for recordings of distant sounds (with N and E like frontal transducers) or close-up recordings (with W and S like frontal transducers) simply by rotating the device 180° and switching from one circuit to the other. In this fourth configuration every resonating/vibrating prong (with two opposite transducers that can also be at different heights) corresponds to its own channel, for industrial applications.

In order to reduce to a minimum the likelihood of possible problems that may arise in this particular configuration when the four transducers are brought closer together or one transducer is positioned closer to the other of the pair, i.e. N with W (a problem that may create for example a spatial deformation of the tridimensional space that is picked-up), it is a good idea to set an almost perfect vertical axis correction for centering the transducers' diaphragm (FIGS. 9/a, b, c, d and e), whilst a reasonable correction on the horizontal axis can also be achieved by reducing the dimensions of the transducers' capsule as much as possible and by bringing N as close as possible to S and the E as close as possible to W. It is inadvisable to bring the distance between the channels (N and B) too closely together in this configuration, bearing in mind the two positioning heights (between N and W, or between E and S) of the transducers.

DISCLOSURE OF INVENTION

Device Configuration Five—A Pair of Transducers Like A Single Human Ear (Sheets 5/5, FIG. 12)—A General Example of Its Operating Principles The invention concerns a device for locating, intercepting, investigating and analysing materials, including biological (and their properties), the capturing and amplifying ultrasonic, sonic and infrasonic waves, the detection of the minutest of movements of masses, even microscopic, and for the picking up of vibrations even of very low amplitude and frequency, in the atmosphere, surrounded by gas, or immersed in water or other types of liquid. It can operate across a wide temperate span, starting at approximately absolute zero, right through to conditions of extreme heat. This special system of sound transducers makes it possible to recognise and analyse objects through one or two transmitters or beacons also placed precisely opposite one another in relation to the fact that this resonator device presents many similarities with the operating principles of a diapason.

It is capable of receiving one or more external signals containing ultrasonic, sonic or infrasonic waves for detecting, investigating or analysing materials and their properties and for other industrial applications (also using one channel when binaural human perception of sounds is not necessary) and is particularly suited for use in the electromedical field.

A single pair of N-W type transducers corresponding to a Left-type human ear, and operates best with sounds from an anticlockwise direction, whilst a single pair of ES type transducers corresponding to a Right-type human ear that, being specular to the other, operates best with sounds from a clockwise direction (the passage from anticlockwise to clockwise direction, and vice versa, occurs through the simple swapping of the two transducers of a single pair, and maintaining the electrical/electronic circuits unaltered for all of the possible configurations: therefore in the first configuration, for example, in Sheet 1/5, the N transducer of the anticlockwise left pair switches from external to internal and assumes the position occupied by W, leaving, therefore the W transducer to become the most extreme outer left).

FIG. 12 furthermore represents an example, that is an explanation that is in no way restrictive, of a large number of possible uses for the device and its associated system, in accordance with the present invention, with the drawing of the pair of N-W transducers (already shown in FIG. 1/a, Sheet 1/5) that shows how the tridimensional ultrasonic, sonic and infrasonic pick up requires that the front part of a capsule that makes up every different type of transducer for this resonator device does not correspond to the frontal zone of the space to picked up and investigated.

The new concept of tridimensional display (in the human binaural perception of sound), from pick up achievable with this precise device, requires that for each possible channel the spherical space on the horizontal axis be theoretically divided into three equal areas (or 3-D volumes), each of 120° (360°÷3=120°), because with only two transducers (one for Left and one for Right) it would be difficult to fix unambiguously a frontal zone that is exactly differentiated from the rear. Therefore two transducers (N, W) will be used for reaching the left ear so that the total of their two "left" directions (Front-Left plus Rear-Left) will give the precise point of convergence of those waves or vibrations which unmistakably originate from the left, whilst the frontal and the rear is picked up by the mirrored direction of the left hand pair of transducers compared to that of the right, correctly adjusted by means of the prevalence of the N signal (with the variable resistor at its terminals, and the negative connection to ground) over the W signal (with the condenser at its terminals) combined with the prevalence of the E over the S (see also the first configuration illustrated on Sheet 1/5).

This resonator device and its associated systems also makes it possible to eliminate the proportionality that exists between measured sound intensity and the distance from the sound source. It can therefore take as points of reference the specific positive and negative amplitude peaks of a precise wavelength with respect to its point of origin.

INDUSTRIAL APPLICABILITY

For Example In Both Professional and Consumer Stereophony (See Sheet 5/5, FIG. 13, FIGS. 15/a and b)

In Sheet 5/5, FIG. 13, it is possible to see in a simplified manner an application that can be used with the first four of the five principal configurations (and their possible modifications: i.e. i) the exchange of the capacitors with variable resistors; ii) the exchange between anticlockwise and clockwise direction for the two pairs of transducers; iii) the connection of each pair of transducers to one another by the positive or negative contacts) where the acoustic signals recorded by this device can be listened to from any position in a room (depending on the set up will result in a fidelity to the original as well as to the fontal position) as long as the speakers or sound diffusers are placed precisely opposite one another, at any height above the floor. The requirement for preferably having the reproduction of one channel opposite the other is to be considered in relation to the fact that this device presents many similarities with the operating principles of a diapason. This realistic and objective listening proves to be to a greater extend tied to subjective impressions when the recordings are listened to through headphones, as shown in FIGS. 15/a and 15/b where the frontality is always rigidly observed, so that ideally the listener is transported to the place where the recording was made. Obviously the sounds can move around inside or outside of the head of the listener in relation to the real position of the sound sources with respect to the device at the moment of recording. This impression of a sound within every specific part of the body (from the head through to the feet) can also be achieved when listening through acoustic speakers every time the listener positions him or herself in the precise location through which the sound is passing, including those areas really behind the two (series of) speakers.

INDUSTRIAL APPLICABILITY

For Example In Configurations For Localised Ultrasound and Infrasound Therapy and Hyperthermia Over 40° C. (Approximately 43° C.) and So On (Sheet 5/5, FIG. 14)

In FIG. 14, it is possible to see an adaptation of the device for use in electromedical practices, where the objective is that of a direct action on the human body by concentrating certain types of sounds directly on specifically identified parts of it. In this case it is possible to operate through types of transducers that include flat acoustic pads that can also be applied to the human body to which they will adhere through the use of appropriate adhesive creams or gels. This type of application could also result in the use of disposable type transducers, with self-adhesive discs, (in this case having a small maximum diameter of 5 or 6 cm) whilst the capsules for transmitting ultrasonic, sonic and infrasonic waves in this example in FIG. 14 should not exceed a diameter of 34 cm. The electrical connection for (extremely low voltage) with two or four capsules could also be achieved for example through the use of appropriate automatic "poppers" such as those used on ECG pads. For this particular type of application, i.e. ultrasonic, sonic and infrasonic treatment and therapy on the body and the brain, for physiology and psychology, for generating vibrations of cancer cells to be treated in a post operative phase, and in all those instances where sound waves can advantageously destroy the structure of the cytoskeleton of the diseased cells, leaving the sound ones intact, it will be necessary to carry out specific types of protocols for programming both the recording and emission of this type of sound, as well as specific signals to samples, so as to arrange waves at the precise points of concentration at certain frequencies, with the possibility of controlling and adjusting exactly both the concentration of the sound waves and the power used during each and every specific treatment.

INDUSTRIAL APPLICABILITY

Note Regarding Industrial Applications In General

The transducers employed for picking up or reproducing ultrasonic, sonic and infrasonic waves and vibrations can be of any type, shape or size, as long as they are sensitive to air particles in the atmosphere or any type of gas or liquid mixture in which they may be placed or immersed. It is also possible to use transducers capable of operating under extreme temperatures conditions, both high/hot as well as low/cold, also in the presence of water vapour, dust, magnetic fields, radioactivity or in the presence of extreme levels of humidity, with pressure levels that differ greatly from that of our own atmosphere, without going beyond the protective remit of this patent, as described, illustrated and claimed further on in this document by the specified aims.

What is claimed is:

1. An electronic resonator device for tri-dimensionally detecting and receiving ultrasonic, sonic and infrasonic waves, even of very low amplitude and frequency, both though an atmosphere and in a fluid, for use in cybernetics and laboratory applications, said device comprising a transducer system for sound waves to be recorded, amplified, directed and concentrated in tri-dimensional form, wherein said transducer system comprises two pairs of transducers for a human left ear and a human right ear, respectively, said transducers of each said pair being adapted to convert vibrations into electrical signals, said transducers being mounted and spatially adjusted on corresponding diapason prong shaped support structures placed side-by-side, said support structures each including transducer supporting tuning diapason prong means and resonating mass means and being so arranged as to receive vibrations and resonances at predetermined frequencies, said pair of transducers being coupled so as to be aligned symmetrically so that two left side transducers of said transducer system are arranged with a mirror relationship with respect to two right side transducer of said resonator device, and wherein two transducers of each transducer pair, for example N-W for a left pair and E-S for a right pair, are spaced at a distance from substantially 2.1 cm to substantially 10.8 cm as said device operates in air at 20° C., whereas, as said device operates in water at 20° C., said distance will be 4.395 greater than said distance in air.

2. A device according to claim 1, wherein said tuning diapason prong means comprise four diapason prongs, each prong having a detection surface thereof pointing in a direction of a respective cardinal point, thereby one faces North, one West, one South and the other East, in an anticlockwise or clockwise direction in 90° steps, thereby said four transducers will cover a horizontal, azimuthal plane of 360°.

3. A device according to claim 1, wherein said device further comprises four amplifiers/preamplifiers power supplied by four separate voltage feeders connected to four separate supply apparatuses.

4. A device according to claim 1, wherein a distance between N and S transducers corresponds to a distance between E and W transducers, said distance being less than or equal to 43.2 cm when said device operates in air at 20° C.

5. A device according to claim 1, wherein a distance between N and E and S and W transducers is less than or equal to 44.0 cm when said device operates in air at 20° C.

6. A device according to claim 1, wherein said device further comprises at least a left sound channel and at least a right sound channel, said left and right sound channels being spaced from one another as to meet a distance relationship:

$$d_{s-w} \cong d\ d_{N-W} \text{ and preferably } d_{s-w} >> d\ d_{N-W}, 31.$$

7. A device according to claim 1, wherein said device comprises a single either left or right channels.

* * * * *

UNITED STATES PATENT AND TRADEMARK OFFICE

CERTIFICATE OF CORRECTION

PATENT NO. : 7,263,034 B2
APPLICATION NO. : 10/505932
DATED : August 28, 2007
INVENTOR(S) : Daniele Ramenzoni It is certified that error appears in the above-identified patent and that said Letters Patent is hereby corrected as shown below:

Col. 24, line 37; in Claim 6, the formula should be: $d_{S\text{-}W} \geqq d_{N\text{-}W}$ and preferably $d_{S\text{-}W} >> d_{N\text{-}W}$ Signed and Sealed this Fifteenth Day of July, 2008

JON W. DUDAS
*Director of the United States Patent and Trademark Office*